US006109781A

United States Patent [19]

Ogasawara et al.

[11] Patent Number: 6,109,781

[45] Date of Patent: Aug. 29, 2000

[54] ELEMENT OF A MIXING APPARATUS

[76] Inventors: Toshiyuki Ogasawara, 28-37-112, Numabukuro 2-chome, Nakano-ku, Tokyo; Noboru Sakano, Nagashima Building 602, 1-57-12, Chuo, Kasukabe-shi, Saitama-ken; Masao Oishi, 97, Yosoji-shi, Shizuoka-ken, all of Japan

[21] Appl. No.: 09/250,995

[22] Filed: Feb. 16, 1999

[51] Int. Cl.[7] ..... B01F 5/06

[52] U.S. Cl. ..... 366/336

[58] Field of Search ..... 366/336, 337, 366/338, 339; 138/42, 44

[56] References Cited

U.S. PATENT DOCUMENTS 4,614,440 9/1986 King ..... 366/336

4,806,288 2/1989 Nowosinski et al. ..... 366/337

*Primary Examiner*—Tony G. Soohoo

*Attorney, Agent, or Firm*—Harrison & Egbert

[57] ABSTRACT

An element of a mixing apparatus having no moving parts. The element includes a hollow cylindrical body provided on an inner surface thereof with projecting plates for disturbing a flow of fluids within the hollow cylindrical body. The hollow cylindrical body is provided on one end thereof with a plurality of projections disposed at regular angular intervals. The hollow cylindrical body is provided on the other end thereof with a plurality of indents disposed at the same regular angular intervals as the projections. Each of the projections of one element is engageable with each of the indents of another element.

1 Claim, 7 Drawing Sheets

ELEMENT OF A MIXING APPARATUS

BACKGROUND OF THE INVENTION (1) Field of the Invention

The present invention relates to an element of a mixing apparatus. More particularly, the invention relates to an element of a mixing apparatus having no moving parts, the mixing apparatus being used for mixing fluids together. For example, the mixing apparatus is used for mixing liquids together, mixing a liquid with a gas or mixing a liquid with a powder.

(2) Description of the Prior Art

A conventional element of a mixing apparatus comprises a hollow cylindrical body provided on an inner surface thereof with projecting plates for disturbing a flow of fluids within the hollow cylindrical body. A plurality of such conventional elements are disposed in a row within a hollow cylindrical case so as to form a mixing apparatus. Fluids to be mixed together are sent into one end of the hollow cylindrical case of the mixing apparatus and passed through the elements disposed within the hollow cylindrical case. In each of the elements, the flow of the fluids is disturbed by the projecting plates on the inner surface of the hollow cylindrical body so that the fluids are mixed together. A mixture of the fluids comes out of the mixing apparatus through the other end of the hollow cylindrical case of the mixing apparatus.

The above-mentioned conventional element of a mixing apparatus has the following disadvantages:

The elements within the hollow cylindrical case of the mixing apparatus need to be arranged at different angular positions so that the fluids passing through the elements are completely mixed together. However, since the conventional element does not have any means for regulating the angles at which the elements are arranged within the hollow cylindrical case, it is difficult to place the elements at different angular positions within the hollow cylindrical case. Also, the elements disposed within the hollow cylindrical case may turn and change their angular positions.

The conventional element is difficult to manufacture because the element comprises a hollow cylindrical body provided on an inner surface thereof with projecting plates for disturbing a flow of fluids within the hollow cylindrical body.

Furthermore, if the conventional element is clogged up with an obstacle, it is difficult to remove the obstacle because the element comprises a hollow cylindrical body having projecting plates on the inner surface thereof.

SUMMARY OF THE INVENTION

It is therefore an object of the invention to provide an element of a mixing apparatus, which element has means for regulating the angles at which the elements are arranged within the hollow cylindrical case of the mixing apparatus.

It is another object of the invention to provide an element of a mixing apparatus, which element is easy to manufacture.

It is a further object of the invention to provide an element of a mixing apparatus, which element is easy to clean even when the element is clogged up with an obstacle.

These and other objects have been attained by an element of a mixing apparatus comprising a hollow cylindrical body provided on an inner surface thereof with projecting plates for disturbing a flow of fluids within the hollow cylindrical body, wherein the hollow cylindrical body is provided on one end thereof with a plurality of projections disposed at regular angular intervals, the hollow cylindrical body being provided on the other end thereof with a plurality of indents disposed at the same regular angular intervals as the projections, each of the projections of one element being engageable with each of the indents of another element.

Preferably the hollow cylindrical body is provided on one end thereof with eight projections disposed at regular angular intervals, the hollow cylindrical body being provided on the other end thereof with eight indents disposed at the same regular angular intervals as the projections, each of the projections of one element being engageable with each of the indents of another element.

The hollow cylindrical body may comprise two halves each having the same semicircular cross section, each of the two halves having means for engaging one another.

The operation of the element of a mixing apparatus according to the present invention will now be described.

A plurality of elements according to the present invention are disposed in a row within a hollow cylindrical case so as to form a mixing apparatus. Fluids to be mixed together are sent into one end of the hollow cylindrical case of the mixing apparatus and passed through the elements disposed within the hollow cylindrical case. In each of the elements, the flow of the fluids is disturbed by the projecting plates on the inner surface of the hollow cylindrical body so that the fluids are mixed together. A mixture of the fluids comes out of the mixing apparatus through the other end of the hollow cylindrical case of the mixing apparatus.

The elements are disposed in a row within the hollow cylindrical case at different angular positions by inserting the projections of each element into the indents of an adjacent element. The angles at which the elements are arranged within the hollow cylindrical case are regulated by the engagement between the projections of the element and the indents of the adjacent element. The elements can be arranged at desired angular positions by selecting the engagement between the projections of the element and the indents of the adjacent element. The engagement between the projections of the element and the indents of the adjacent element prevents the elements within the hollow cylindrical case from turning and changing their angular positions.

When the element has eight projections and eight indents respectively provided at regular angular intervals on the ends thereof, the angular intervals between these projections and between these indents are respectively 45°. Therefore, the elements can be disposed at angular intervals of 45° or 90° for example.

The hollow cylindrical body comprising two halves each having the same semicircular cross section is formed by fitting the two halves together by the engagement means. Each of the two halves is easy to manufacture. The two halves forming the hollow cylindrical body can be easily detached from one another in order to facilitate cleaning.

DETAILED DESCRIPTION OF THE INVENTION

The present invention will now be described in detail with reference to the attached drawings.

Figure 1:
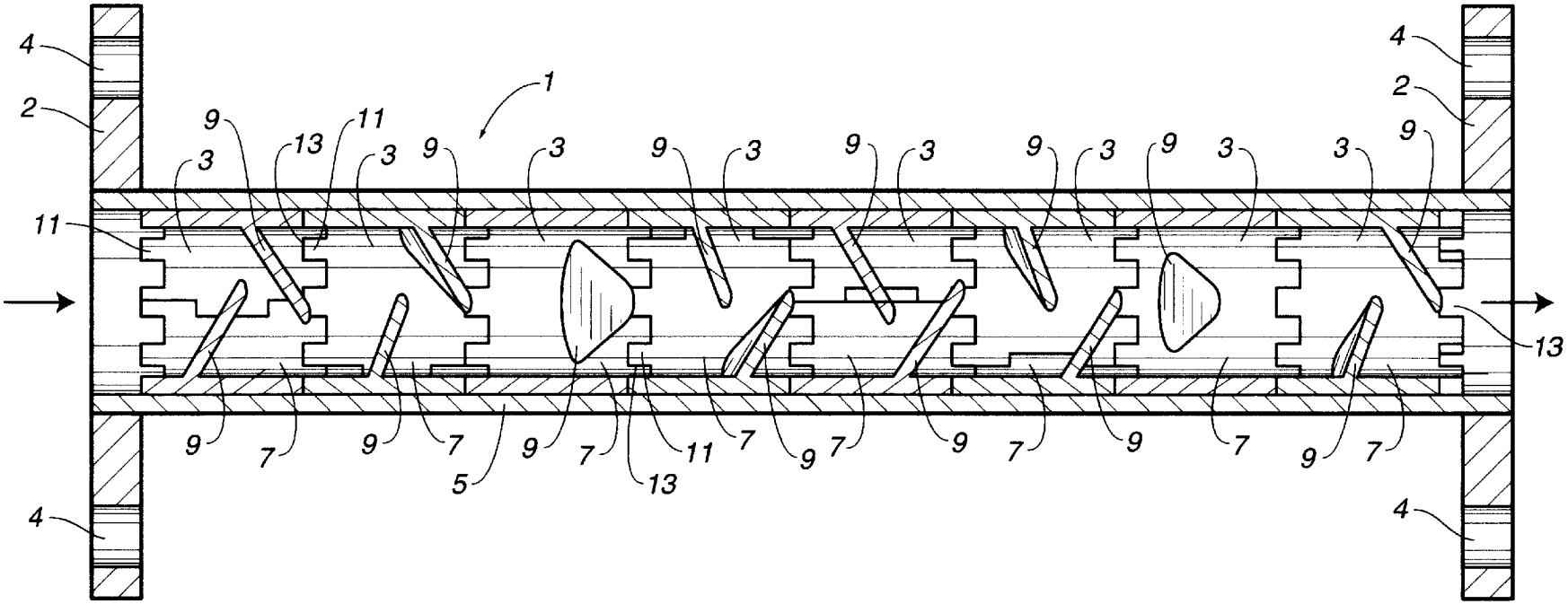
FIG. 1 is a sectional view showing a mixing apparatus containing elements according to the present invention.
Figure 2:
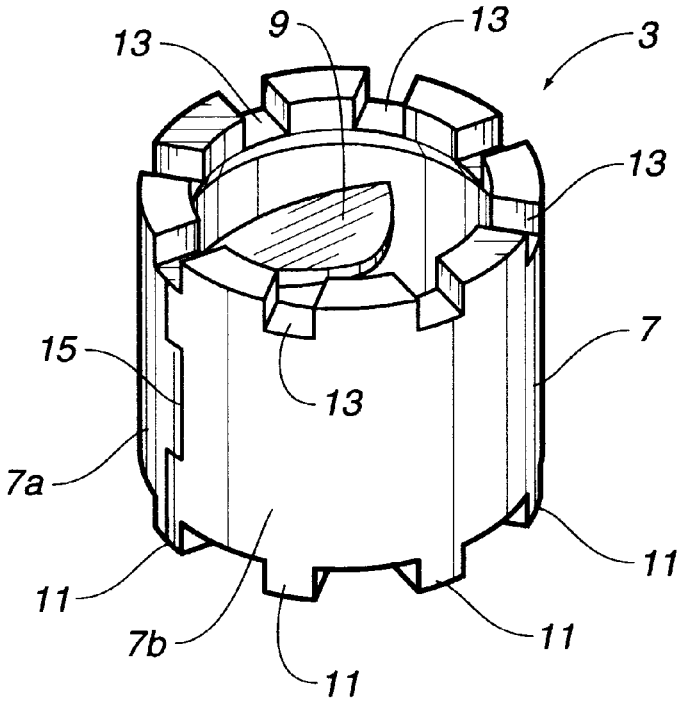
FIG. 2 is a perspective view showing an element according to the present invention.
Figure 3:
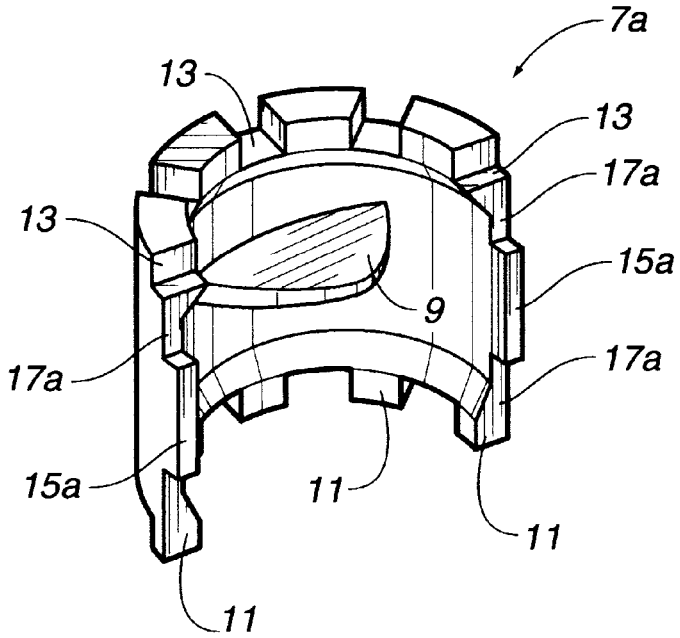
FIG. 3 is a perspective view showing a half of a hollow cylindrical body.
Figure 4:
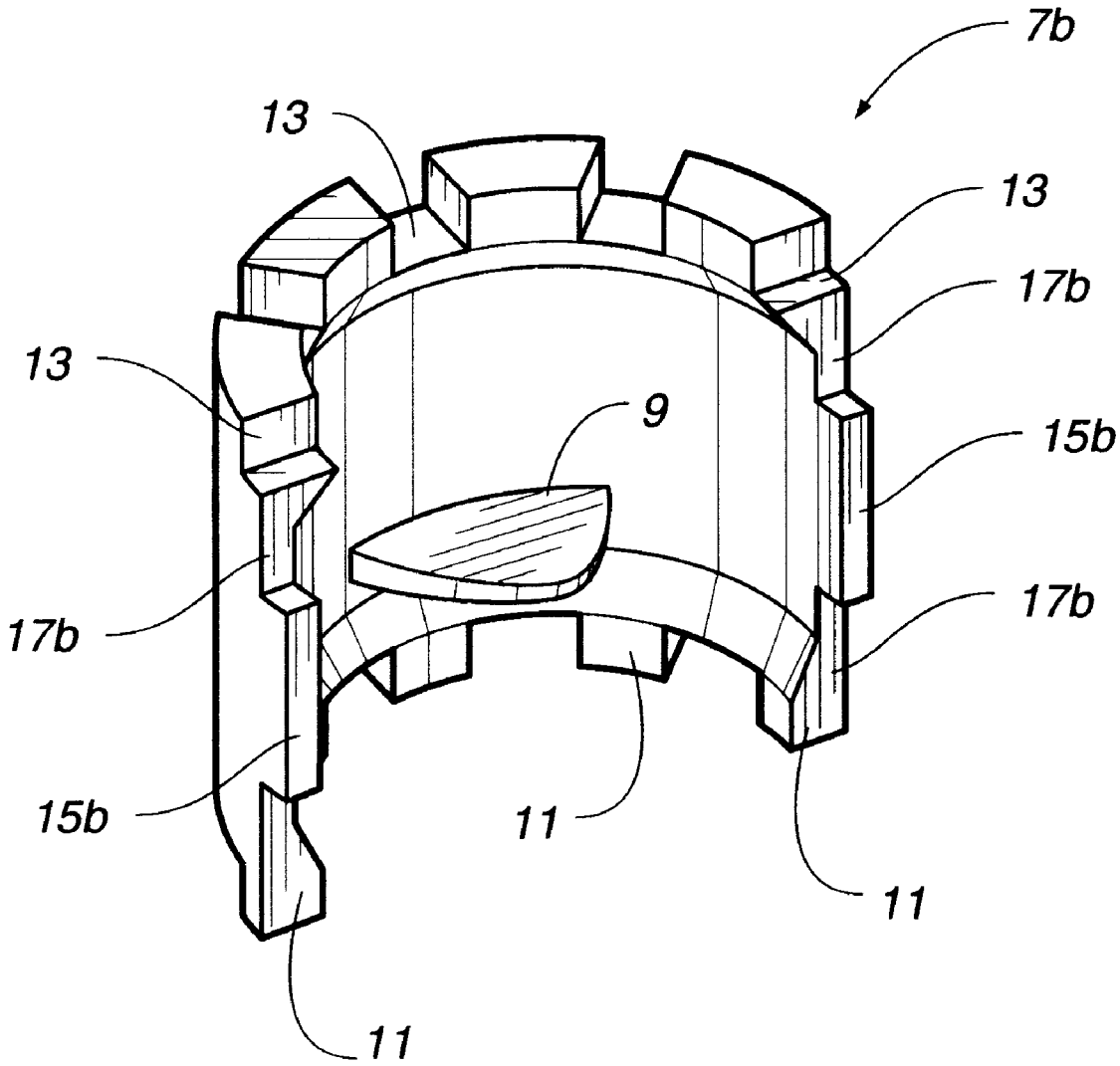
FIG. 4 is a perspective view showing another half of a hollow cylindrical body.
Figure 5:
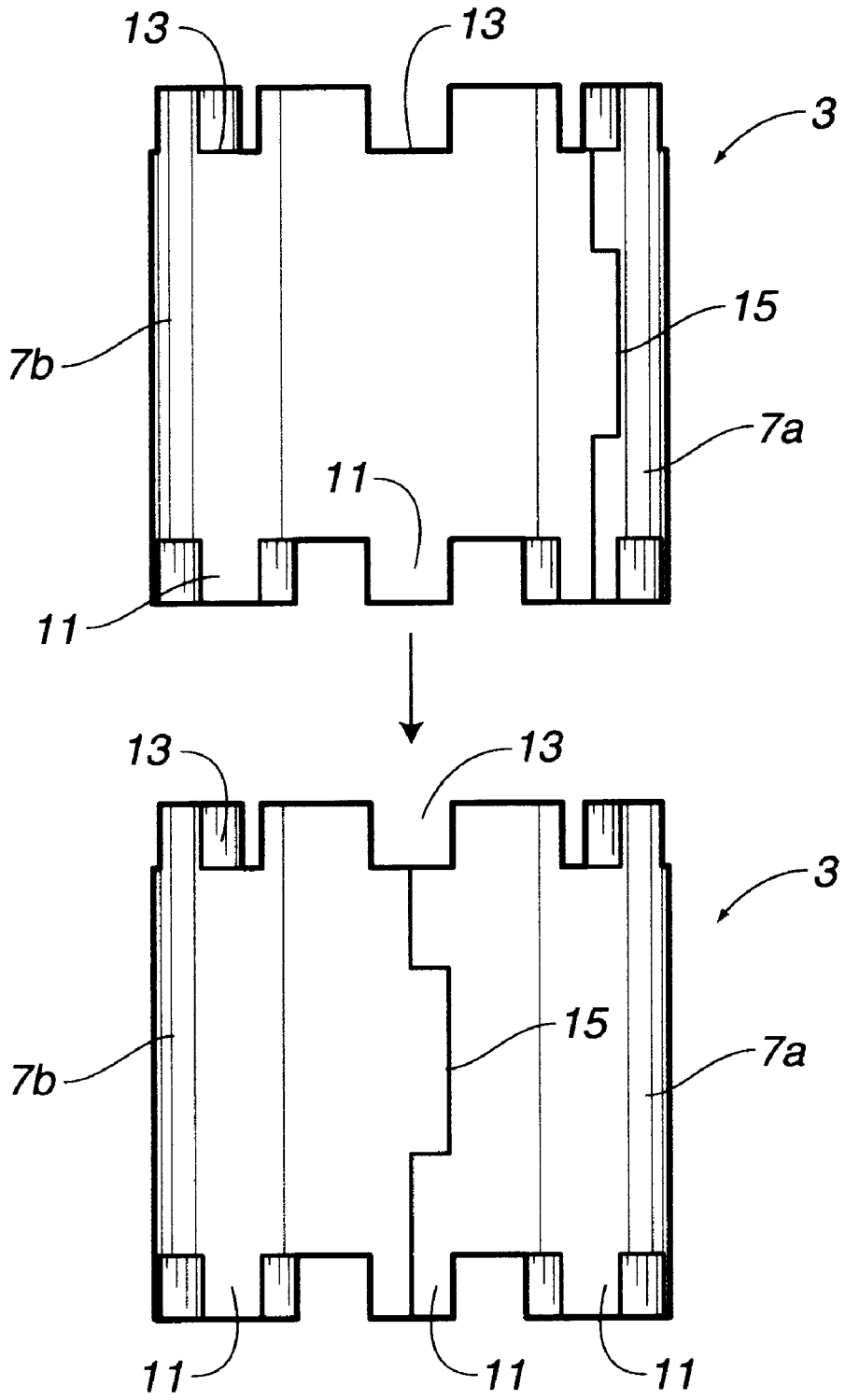
FIG. 5 is a front view showing two elements.

A mixing apparatus 1 shown in FIG. 1 contains eight elements 3 within a hollow cylindrical case 5. The mixing apparatus 1 has no moving parts. The hollow cylindrical case 5 is provided with a flange 2 at each of its two ends. Each flange 2 has holes 4 for fixing the hollow cylindrical case 5 to a supporting means by fixing means such as bolts. Each element 3 comprises a hollow cylindrical body 7 provided on an inner surface thereof with projecting plates 9 for disturbing a flow of fluids within the hollow cylindrical body 7. The hollow cylindrical body 7 is preferably provided with two projecting plates 9 on the opposite sides of the inner surface thereof. The projecting plates 9 are inclined with respect to the axis of the hollow cylindrical body 7.

Figure 6:
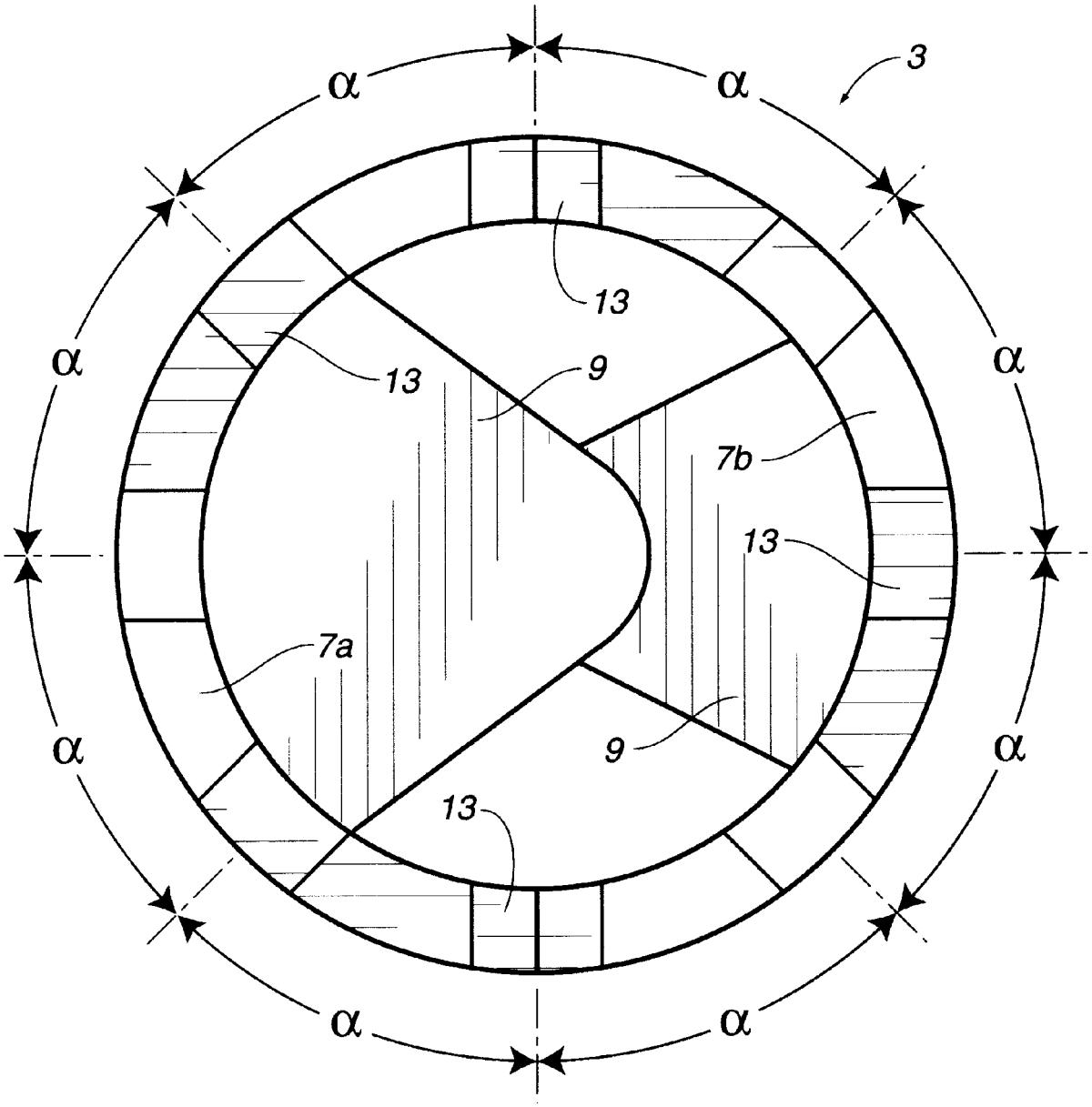
FIG. 6 is a top view of an element.
Figure 7:
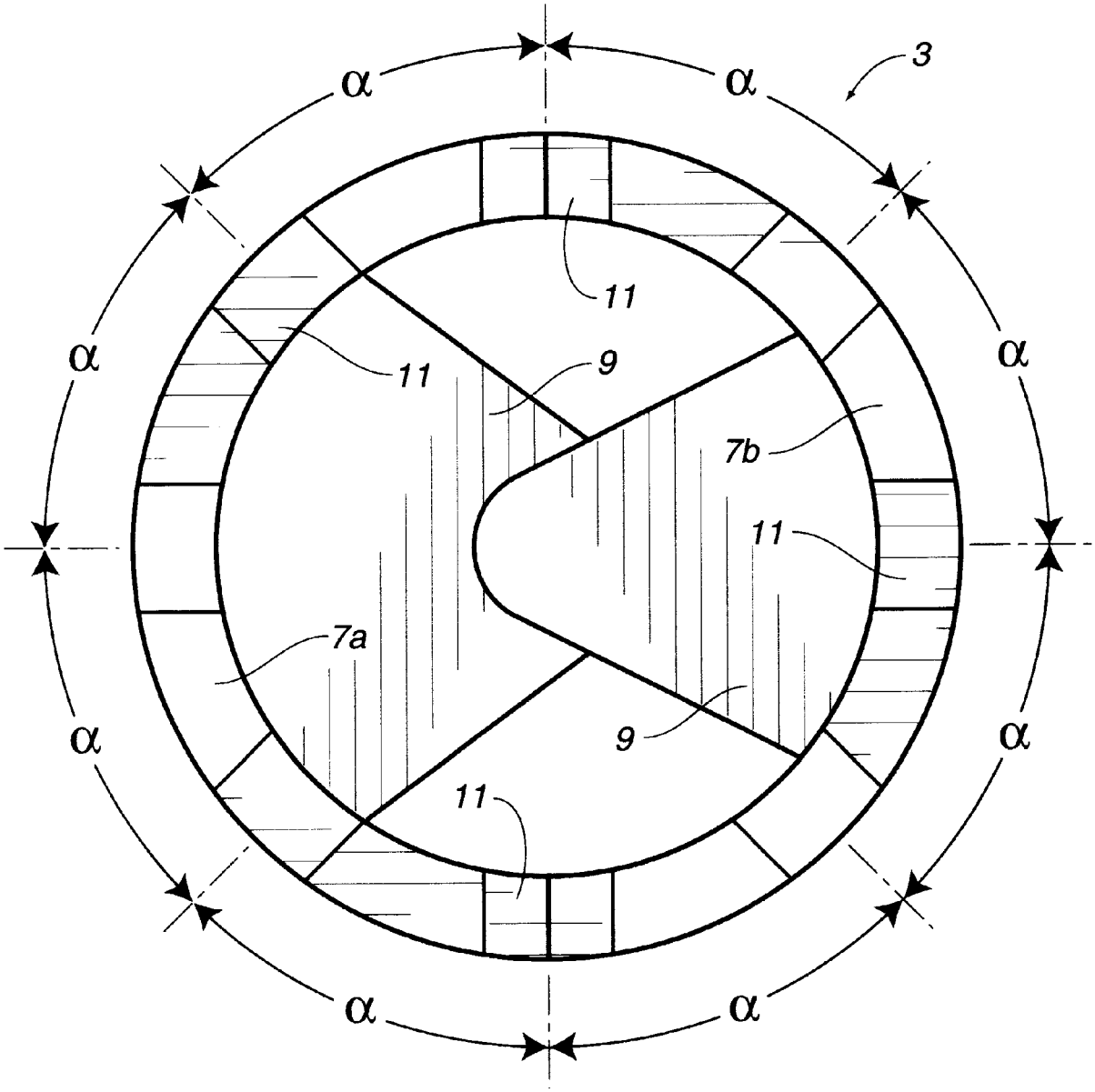
FIG. 7 is a bottom view of an element.

According to the present invention, the hollow cylindrical body 7 is provided on one end thereof with a plurality of projections 11 disposed at regular angular intervals $\alpha$. The hollow cylindrical body 7 is provided on the other end thereof with a plurality of indents 13 disposed at the same regular angular intervals $\alpha$ as the projections 11. See FIGS. 6 and 7. Each of the projections 11 of one element 3 is engageable (can be engaged) with each of the indents 13 of another element 3.

In an illustrated embodiment, the hollow cylindrical body 7 is provided on one end thereof with eight projections 11 disposed at regular angular intervals $\alpha$ of 45°, the hollow cylindrical body 7 being provided on the other end thereof with eight indents 13 disposed at regular angular intervals $\alpha$ of 45° which is the same as the angular intervals of the projections 11.

The hollow cylindrical body 7 may comprise two halves 7*a* and 7*b* each having the same semicircular cross section. Each of the two halves 7*a* and 7*b* has means 15 for engaging one another. The means 15 comprises projections 15*a* provided on the edges 17*a* of one half 7*a* facing the edges 17*b* of the other half 7*b*, and indents 15*b* provided on the edges 17*b* of the other half 7*b*. Each of the halves 7*a* and 7*b* is provided on one end thereof with a plurality of projections 11 disposed at regular angular intervals. Each of the halves 7*a* and 7*b* is provided on the other end thereof with a plurality of indents 13 disposed at the same regular angular intervals as the projections 11. Each of the projections 11 of the halves 7*a* and 7*b* of one element 3 is engageable with each of the indents 13 of the halves 7*a* and 7*b* of another element 3. Each of the halves 7*a* and 7*b* is provided on an inner surface thereof with a projecting plate 9 for disturbing a flow of fluids within the hollow cylindrical body 7.

Figure 8:
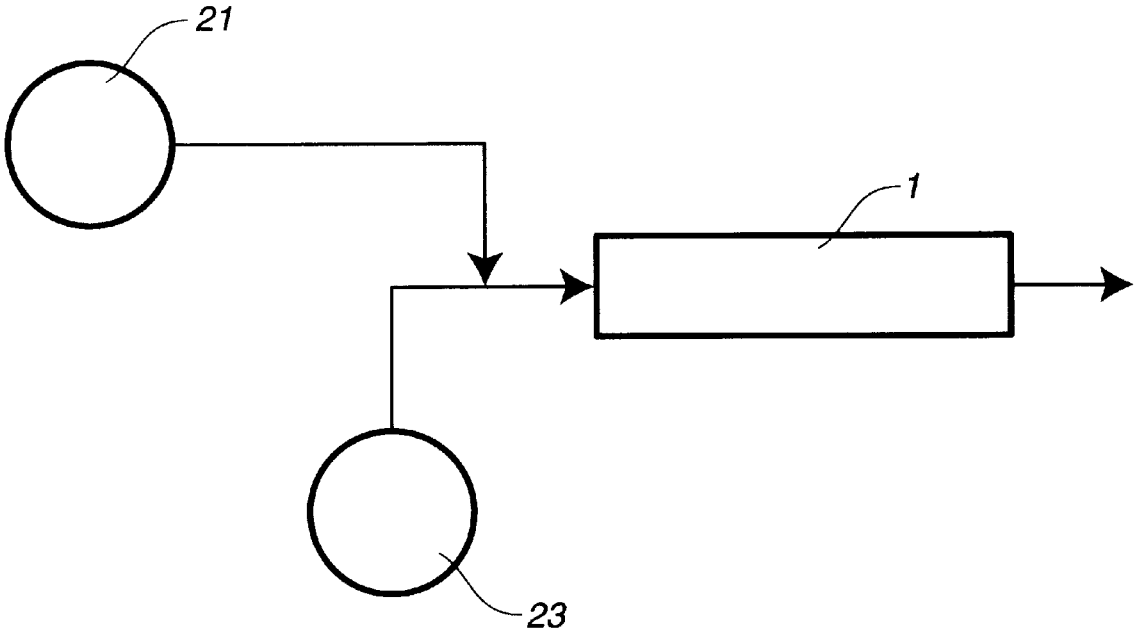
FIG. 8 is a schematic view showing a mixing apparatus.

In an example shown in FIG. 8, a gas supply means 21, such as an air compressor, and a liquid supply means 23, such as a water pump, are connected to the mixing apparatus 1. In this example, a gas and a liquid are mixed in the mixing apparatus 1.

The present invention has the following advantages:

Since the angles at which the elements are arranged within the hollow cylindrical case are regulated by the engagement between the projections of each element and the indents of an adjacent element, the elements can be arranged at desired angular positions by selecting the engagement between the projections of the element and the indents of the adjacent element. The engagement between the projections of the element and the indents of the adjacent element prevents the elements within the hollow cylindrical case from turning and changing their angular positions.

When the element has eight projections and eight indents respectively provided at regular angular intervals on the ends thereof, the angular intervals between these projections and between these indents are respectively 45°. Therefore, the elements can be disposed at angular intervals of 45° or 90° for example.

When the hollow cylindrical body comprises two halves each having the same semicircular cross section, each of the two halves can be easily manufactured by investment casting, for example. Also, if the element is clogged up with an obstacle, the two halves can be detached from one another in order to facilitate removing the obstacle.

As many apparently widely different embodiments of the present invention may be made without departing from the spirit and scope thereof, it is to be understood that the invention is not limited to the specific embodiments thereof except as defined in the appended claims.

What is claimed is:

1. A mixing apparatus comprising:

a first element having a hollow cylindrical body provided on an inner surface thereof with projecting plates for disturbing a flow of fluids within the hollow cylindrical body, wherein said hollow cylindrical body comprises two halves each having an identical semicircular cross section, each of said two halves having means for engaging one another, each of said two halves being provided on one end thereof with a plurality of projections disposed at regular intevals, each of said two havles being provided on another end thereof with a plurality of indents disposed at identical regular intervals as said projections; and a second element having a hollow cylindrical body provided on an inner surface thereof with projecting plates for disturbing a flow of fluids therein, said hollow cylindrical body of said second element being provided on one end thereof with a plurality of projections disposed at regular intervals, said hollow cylindrical body of said second element being provided an another end thereof with a plurality of indents disposed at identical regular intervals as said plurality of projections of said second element, each of said projections of said first element being engageable with each of said indents of said second element.

* * * * *